US006012503A

United States Patent [19]

Balder

[11] Patent Number: 6,012,503

[45] Date of Patent: Jan. 11, 2000

[54] ADJUSTABLE GLUING APPARATUS FOR A PACKAGING MACHINE

[75] Inventor: Richard E. Balder, Brainerd, Minn.

[73] Assignee: Riverwood International Corporation, Atlanta, Ga.

[21] Appl. No.: 08/979,729

[22] Filed: Nov. 26, 1997

[51] Int. Cl.[7] ..... B65C 11/04; B65B 7/00; B65B 43/38; B05C 1/00

[52] U.S. Cl. ..... 156/578; 156/69; 156/295; 156/356; 118/222; 118/DIG. 3; 427/285; 53/383.1; 493/128

[58] Field of Search ..... 156/69, 290, 295, 156/356, 357, 578; 118/222, 680, DIG. 3; 427/285, 286, 208.2; 53/383.1; 493/128

[56] References Cited

U.S. PATENT DOCUMENTS 3,218,216 11/1965 Stephens et al. ..... 156/362
3,382,530 5/1968 Glesner ..... 156/578
4,087,303 5/1978 Strzalka ..... 156/357
5,027,976 7/1991 Scholl et al. ..... 222/1

*Primary Examiner*—Richard Crispino
*Assistant Examiner*—J. A. Lorengo
*Attorney, Agent, or Firm*—Skinner and Associates

[57] ABSTRACT

An adjustable gluing apparatus for dispensing glue onto articles, such as flaps of cartons on a packaging machine. A glue dispensing head attached to a clamping block is moved along a bar by a rack and pinion gear arrangement. The bar has rack teeth, and the pinion gear and attached pinion shaft are supported by the clamping block, which has an aperture receiving the bar. Turning an adjustment knob connected to the pinion shaft adjusts the position of the clamping block relative to the bar. Rotation of the pinion shaft is selectively allowed or prevented by a locking knob threadably engaged with the pinion shaft. The clamping block is further secured to the bar by a screw in the clamping block which contacts the back side of the bar to provide teeth-engagement adjustment for the rack and pinion gear teeth. The screw has an adjusting knob and a locking knob similar to that on the pinion shaft.

20 Claims, 4 Drawing Sheets

ADJUSTABLE GLUING APPARATUS FOR A PACKAGING MACHINE

BACKGROUND OF THE INVENTION

1. Field of the Invention

The present invention relates, generally, to packaging machinery. More particularly, the invention relates to devices for applying glue to cartons on a packaging machine.

2. Background Information

A common type of packaging machine processes a large volume of individual articles by arranging and grouping the articles, loading a group of articles into a carton, closing and sealing the cartons, and dispensing the loaded cartons to an area where they are consolidated for shipping. A typical carton is constructed of paperboard or corrugated paper and has flaps which are folded closed and sealed with glue.

The state of the art includes various devices for applying glue to cartons on a packaging machine. A common type of glue used to seal paperboard cartons is a hot-melt material. The glue is heated in a central container and pumped to individual dispensing stations. The dispensing stations and hoses between the dispensing stations and the central container often are also heated to keep the glue at the proper viscosity for dispensing. Devices on the dispensing stations have at least one nozzle, and often have a plurality of nozzles through which the glue is applied to flaps of cartons as cartons pass by the dispensing station.

Prior art devices for applying glue to cartons are believed to have significant limitations and shortcomings. The devices are often custom-made wherein the nozzles are in a fixed predetermined location. A custom-made device may be relatively expensive. As carton size changes for different size articles or different group configurations, the position of the flaps typically changes, thereby requiring a change in the position of the nozzles on the dispensing station. A glue dispensing station on a packaging machine typically has a number of custom-made devices, each with a different nozzle configuration for a specific carton configuration run on the machine. An inventory of several custom-made devices for a dispensing station is relatively expensive.

When a changeover is made on the packing machine to run a different carton, one glue dispensing device is removed and another device is installed. Such an operation can be time consuming and risk damage to the devices. The devices are hot from the glue, and care must be taken that personnel are not burned when removing a device. The devices may be allowed to cool before being removed, which takes time. Hoses attached to a device must be disconnected and reattached either to the devices or to the glue supply. This risks damage to the hoses each time a connection is changed. Air may also be undesirably introduced into the system by the new hose connection. The new device and hoses must be heated to the working temperature before the operation of the machine can be resumed. This also takes time.

Such devices may be rather bulky requiring a space of one to two linear feet of the packaging machine. On a packaging machine where space is limited, this may be too much.

Applicant's invention overcomes the limitations and shortcomings of the prior art by providing an apparatus which uses a plurality of small, standard glue dispensing devices and provides for positional adjustment of them so the same devices can be used for all carton configurations run on a packaging machine. The apparatus and dispensing devices are cost-effective and require less than one linear foot of space on the packaging machine.

BRIEF SUMMARY OF THE INVENTION

The present invention provides an adjustable apparatus for dispensing glue onto articles, such as flaps of cartons on a packaging machine. The apparatus comprises a glue dispensing head, a clamping block connected to the glue dispensing head, a rotatable pinion gear supported by the clamping block, and a rack having teeth which engage the pinion gear. The clamping block has an aperture, preferably rectangular which receives the rack, which preferably has a square or rectangular cross section. The clamping block and glue head are moved along the rack as the pinion gear is rotated by manually turning a knob attached to a pinion shaft connected to the pinion gear. A locking knob threadably engaged with the pinion shaft prevents or allows rotation of the pinion shaft when the locking knob is selectively engaged or disengaged respectively with the clamping block. A screw threadably engaged with the clamping block has an end which extends into the rectangular aperture to contact the back side of the rack to provide teeth-engagement adjustment for the rack and pinion gear teeth. The screw has an adjusting knob on its other end and a locking knob threadably engaged with the screw and disposed between the adjusting knob and the clamping block. The screw can be tightened to further secure the clamping block in position relative to the rack, and the locking knob tightened to hold it there. A flap guide bracket attached to the glue head pushes flaps of loaded cartons closed against articles in the cartons as the cartons move past the gluing apparatus. Glue is expelled from nozzles in the glue head and deposited on the flaps. Glue supply lines remain attached to the glue dispensing head during positional adjustment of the apparatus.

By using a plurality of clamping block/glue dispensing head assemblies on the same rack, a wide variety of carton sizes can be accommodated by the same gluing apparatus by simply adjusting the position of the glue dispensing heads to apply the glue in the proper locations. Position adjustment for changeover to a new package size can be accomplished quickly, easily, and cleanly.

The features, benefits and objects of this invention will become clear to those skilled in the art by reference to the following description, claims and drawings.

DETAILED DESCRIPTION

Figure 1:
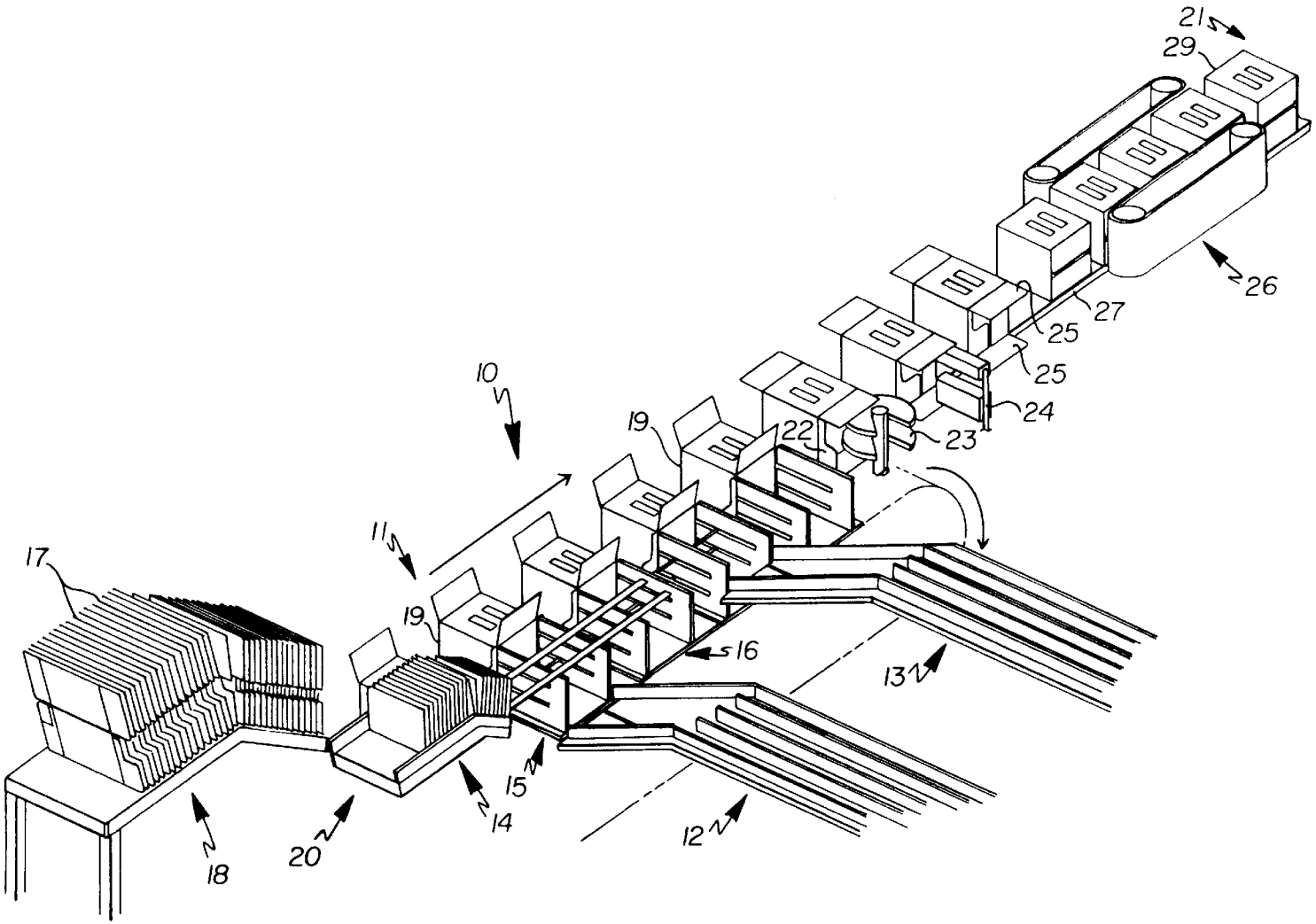
FIG. 1 is a perspective view schematically illustrating a packaging machine on which gluing apparatus of the present invention can be used.

Referring to FIG. 1, an example packaging machine 10 is schematically shown to illustrate the relation of a gluing apparatus to other portions of the machine and the packaging process. While the packaging machine 10 shown is used to package a stacked group of beverage cans in a paperboard carton, the invention is applicable to any packaging machine configuration which uses glue to secure carton flaps, or for other purposes.

Example packaging machine 10 has a carton stream or line 11, a lower article supply stream or line 12, a second or high article supply stream or line 13, a divider sheet feeder 14, and a grouping container line 15 having a plurality of grouping containers 16. Carton line 11 takes carton blanks 17 from a carton blank magazine 18 opens them into cartons 19, and conveys cartons 19 longitudinally on conveyor 27 from an upstream end 20 of the machine to a downstream output end 21. Grouping containers 16 run parallel and adjacent to open cartons 19 for a portion of the carton line 11. Carton line 11 and grouping container line 15 move intermittently. When grouping containers 16 are in proper alignment with article supply lines 12 and 13, articles (not shown) flow along article supply lines 12 and 13 into grouping containers 16. Divider sheet feeder 14 supplies a divider sheet on top of the lower articles received from article supply line 12 to facilitate upper articles from article supply line 13 sliding over the lower articles in grouping container 16. Grouped articles are loaded from grouping container 16 into open cartons 19, then inner flaps 22 are closed by a flap closing apparatus 23, glue is applied to the closed inner flaps 23 by a gluing apparatus 24, and outer flaps 25 are closed by another flap closing apparatus (not shown). The closed cartons then pass through a compression section 26 which holds the flaps closed while the glue sets. The completed package 29 is then discharged at the output end 21 of the machine.

Figure 2:
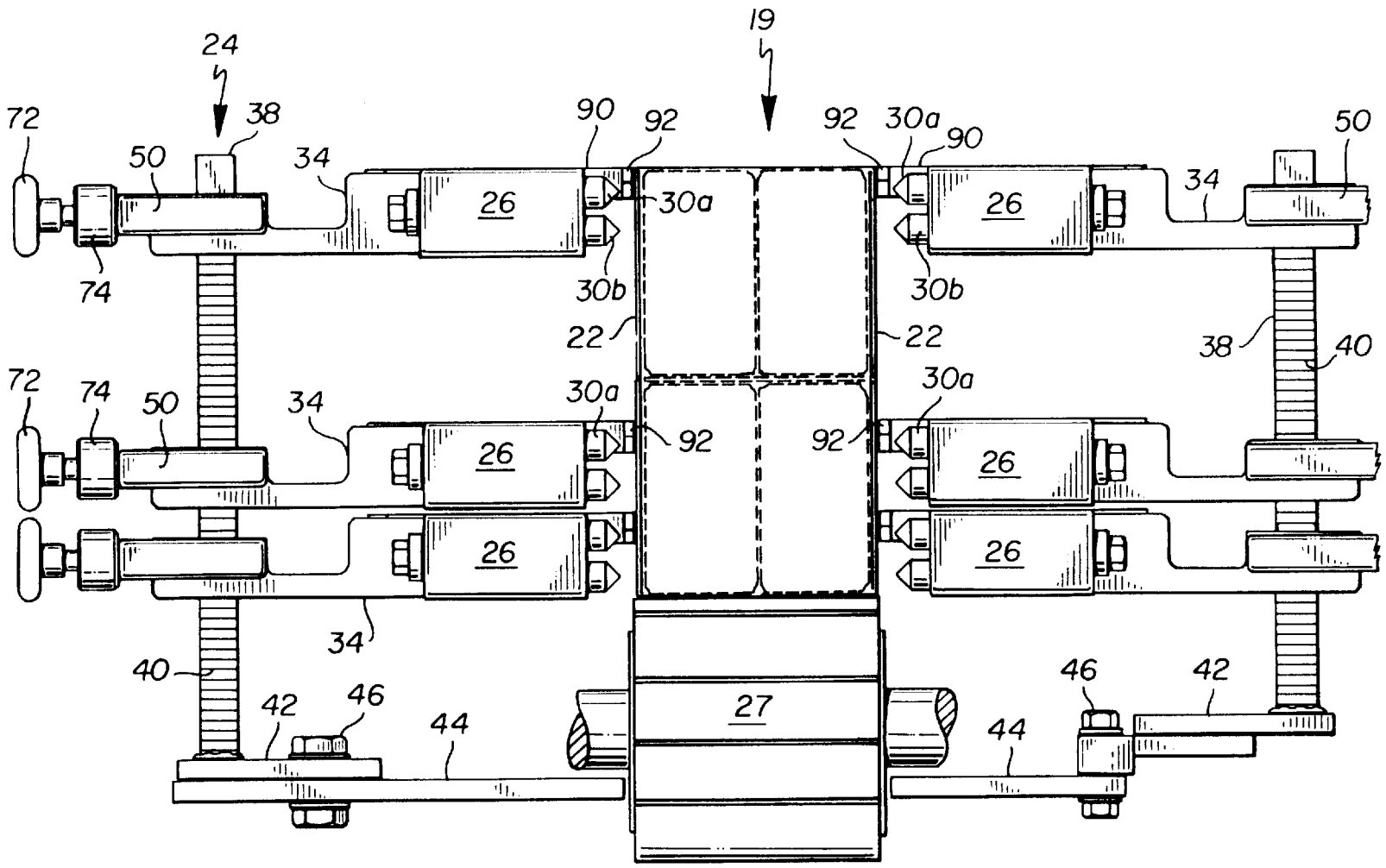
FIG. 2 is an end view of a portion of a packaging machine showing several of the gluing apparatuses as used with cartons containing a stacked group of articles.
Figure 3:
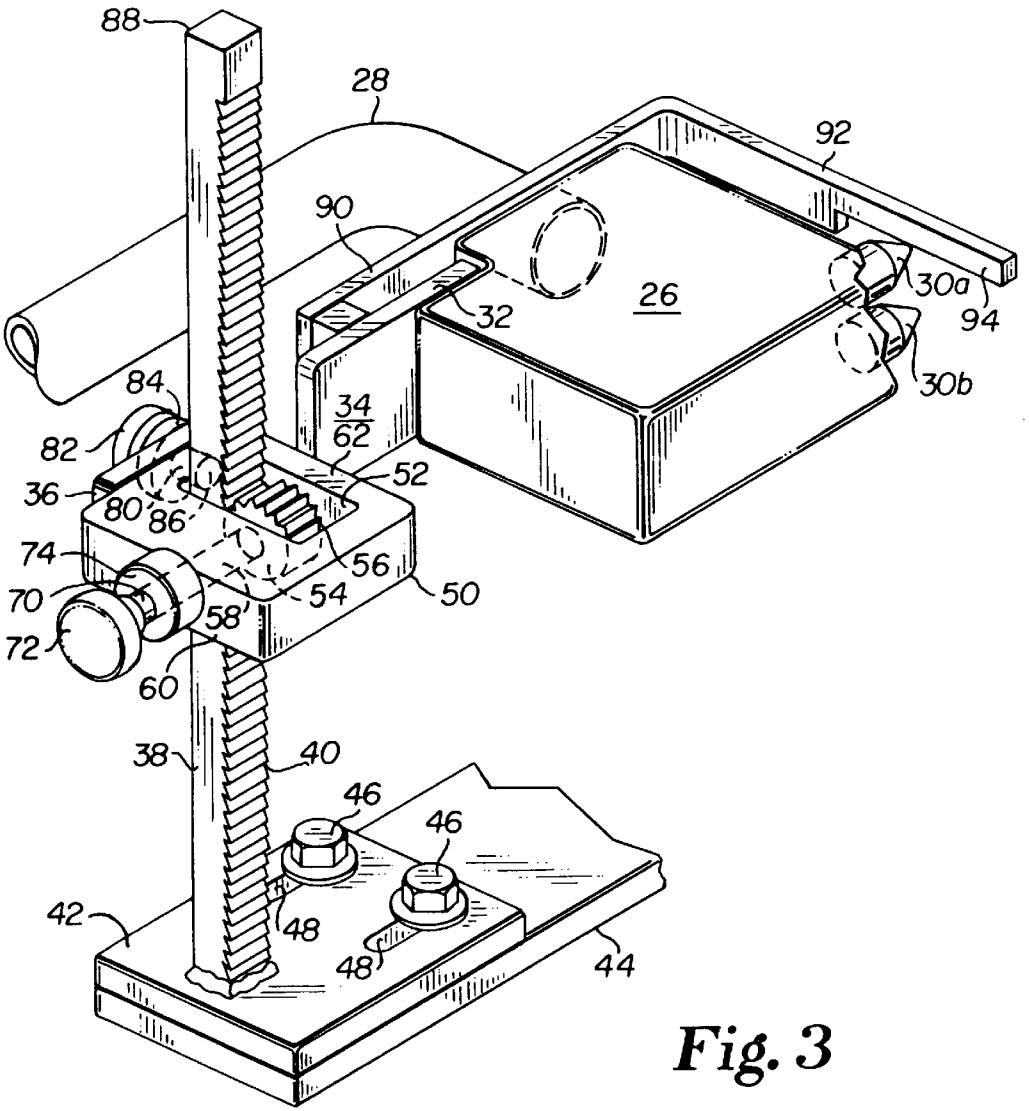
FIG. 3 is a detailed perspective view of the gluing apparatus.
Figure 4:
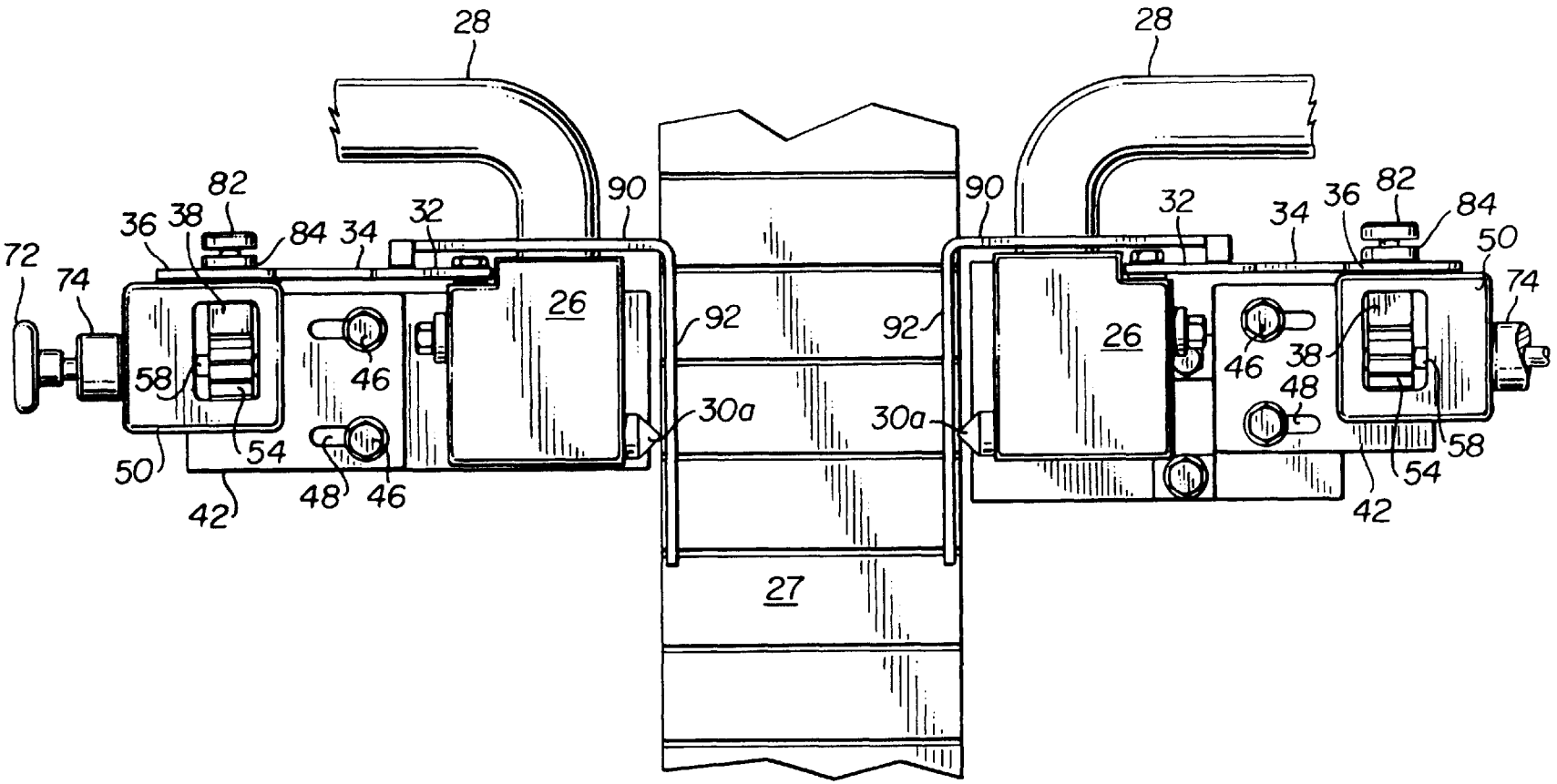
FIG. 4 is a top view of the gluing apparatus of FIG. 2.

Referring to FIGS. 2–4, the gluing apparatus 24 makes use of conventional, inexpensive, compact glue dispensing heads 26 such as model H202 manufactured by Nordson Corporation. Such a glue dispensing head has an input hose 28 communicatively connected to a central source of glue (not shown) and to the dispensing head 26. Hot-melt glue is pumped from the central source through hose 28 to dispensing head 26 where it is dispensed through at least one discharge nozzle 30. The glue dispensing head 26 shown has two discharge nozzles 30*a* and 30*b*, and is oriented so that the two nozzles 30*a* and 30*b* are disposed vertically. Glue is dispensed from nozzles 30*a* and 30*b* onto flaps 22 of loaded carton 19 traveling on conveyor 27.

Glue dispensing head 26 is attached to a first end portion 32 of mounting bracket 34. The other end portion 36 of mounting bracket 34 is attached to a clamping block 50. Clamping block 50 can be moved along column 38 by any suitable means to adjust the position of the glue dispensing head 26, thereby adjusting the position of the glue applied to carton flaps 22. Column 38 may be smooth and clamping block 50 may have a sliding clamp mechanism to engage column 38, but preferably, a rack and pinion gear arrangement is used. Column 38 is shown oriented vertically to provide vertical position adjustment of the glue dispensing head 26, but column 38 may be mounted horizontally, or at any angle to provide variable glue position in any desired direction. Column 38 may also be curved.

Column 38 preferably has a square or rectangular cross section and has rack teeth 40 on one side. Column 38 is attached, preferably by welding, to a base plate 42. Base plate 42 is fastened to frame member 44, preferably by mechanical fasteners such as bolts 46, Frame member 44 may be a stationary portion of machine 10 or a laterally adjustable member, such as an accessory rail. Base plate 42 may have slots 48 to allow lateral position adjustment of base plate 42 relative to frame member 44 thereby providing lateral position adjustment of glue dispensing heads 26 to accommodate different width cartons 19.

Clamping block 50 preferably has a rectangular aperture 52 which receives column 38. A pinion gear 54 is also disposed in aperture 52 and has pinion teeth 56 which engage rack teeth 40 of column 38. Pinion gear 54 is attached to a rotatable height adjustment shaft 58 which extends through clamping block 50. Shaft 58 may be supported only by the front portion of clamping block 50 between outer surface 60 and aperture 52, or shaft 58 may be further supported by extending into or through rear potion 62 of clamping block 50 beyond aperture 52. Height adjustment shaft 58 has a portion 70 which extends beyond outer surface 60 of clamping block 50 and which has two knobs: an adjustment knob 72 at its end, and a locking knob 74 disposed between the adjustment knob and outer surface 60 of clamping block 50. Adjustment knob 72 is fixedly attached to portion 70 of shaft 58, and locking knob threadably engages portion 70 of shaft 58. When locking knob 74 is loose with respect to outer surface 60, the height of clamping block 50 can be adjusted on column 38 by rotating adjustment knob 72, thereby rotating pinion gear 54 to move clamping block 50 up or down column 38. When locking knob 74 is rotated to snugly engage outer surface 60 of mounting block 50, rotational movement of shaft 58 is prevent thereby locking clamping block 50 into vertical position.

Clamping block 50 may be further clamped on column 38 by the tooth engagement adjustment mechanism comprising screw 80, adjusting knob 82, and locking knob 84. Screw 80 passes through end portion 36 of bracket 34 and threadably engages clamping block 50. Screw 80 has an end 86 which engages column 38 on side 88 which is opposite rack teeth 40. Adjusting knob 82 is fixedly attached to screw 80 at the end opposite end 86, and locking knob 84 threadably engages screw 80 and is disposed between adjusting knob 82 and end portion 36 of bracket 34. How tightly rack teeth 40 and opinion teeth 56 engage each other is controlled by rotating adjusting knob 82, which rotates screw 80 to move end 86 into or out of aperture 50 and into or out of engagement with side 88 of column 38. Knob 82 can be rotated to tightly engage end 86 of screw 80 against side 88 of column 38, then locking knob 84 can be rotated to secure screw 80 in that position to further clamp clamping block 50 to column 38.

To adjust a clamping block vertically, locking knob 84 is loosened, then adjusting knob 82 is backed of a little to allow rack and pinion teeth to move properly. Locking knob 74 is loosened, then adjustment knob 72 is turned to move clamping block 50 to the desired position along column 50. Locking knob 74 is tightened, and knobs 82 and 84 may also then be tightened.

A flap guide bar 90 is attached to mounting bracket 34 and has a portion 92 which extends parallel to the direction of travel of cartons 19 and is disposed between glue dispensing head 26 and flap 22 of carton 19. As loaded cartons 19 move on conveyor 27, flap 22 runs against portion 92 which pushes flap 22 closed against articles in carton 19 as glue is expelled from nozzles 30*a* and 30*b* and deposited on flap 22. Portion 92 is preferably positioned just above nozzle 30*a*. Portion 92 has a notched section 94 adjacent nearest nozzle 30*a* so that glue expelled from nozzle 30*a* will not be deposited on flap guide bar 90.

By using a plurality of glue dispensing head 26, mounting bracket 34 and clamping block 50 assemblies on a column 38, a wide variety of carton sizes can be accommodated by the same gluing apparatus 24 by simply adjusting the position of the glue dispensing heads to apply the glue in the proper locations. Hoses 28 can remain attached to the glue dispensing heads 26, and position adjustment for changeover to a new package size can be accomplished quickly, easily, and cleanly.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed is:

1. An adjustable apparatus for dispensing glue onto side flaps of loaded cartons moving past the apparatus on a packaging machine, comprising:

(a) a glue head for dispensing glue onto the side flaps of the loaded cartons;

(b) a clamping block connected by a bracket to the glue head;

(c) a flap guide connected to the bracket, the flap guide having a guide portion adapted for pushing the side flaps of loaded cartons closed against articles in the loaded cartons as the cartons move past the apparatus and as the glue head dispenses glue onto the side flaps; and (d) a position adjustment assembly supported by the clamping block, the position adjustment assembly including a gear assembly adapted for moving the clamping block and positioning the flap guide and the glue head proximate to the side flaps in a desired position for loaded cartons of a particular size.

2. The apparatus of claim 1, wherein the gear assembly includes a rack and pinion.

3. The apparatus of claim 2 further comprising a pinion shaft supported by the clamping block, the pinion shaft having a first end portion attached to the pinion.

4. The apparatus of claim 3, wherein the pinion shaft has a second end portion, and further comprising an adjustment knob attached to the second end portion of the pinion shaft such that rotation of the adjustment knob rotates the pinion shaft.

5. The apparatus of claim 3, wherein the clamping block has a first aperture which receives the rack.

6. The apparatus of claim 5, wherein the clamping block has a second aperture normal to the first aperture, the second aperture extending from the first aperture through at least a portion of the clamping block, the second aperture receiving the pinion shaft.

7. The apparatus of claim 6, wherein the pinion shaft has a threaded portion, and further comprising a locking knob threadably engaged with the threaded portion of the pinion shaft, the locking knob being rotatable relative to the pinion shaft to selectively engage and disengage the clamping block.

8. The apparatus of claim 5, wherein the rack is an elongated bar having a first side and a second side, the first side having rack teeth, and the second side being substantially flat and disposed opposite the first side.

9. The apparatus of claim 8, wherein the first aperture is rectangular.

10. The apparatus of claim 9, wherein the pinion is disposed substantially within the first aperture.

11. The apparatus of claim 8, further comprising a teeth-engagement adjusting shaft threadably engaged with the clamping block, the teeth-engagement adjusting shaft having a first end which selectively engages and disengages the second side of the rack.

12. The apparatus of claim 11, wherein the teeth-engagement adjusting shaft has a second end portion opposite the first end, and further comprising an adjusting knob attached to the second end portion of the teeth-engagement adjusting shaft such that rotation of the adjustment knob rotates the teeth-engagement adjusting shaft.

13. The apparatus of claim 12, wherein the teeth-engagement adjusting shaft has a threaded portion, and further comprising a locking knob threadably engaged with the threaded portion of the teeth-engagement adjusting shaft, the locking knob being rotatable relative to the teeth-engagement adjusting shaft to selectively engage and disengage the clamping block.

14. The apparatus of claim 13, wherein the locking knob is disposed between the adjustment knob and the clamping block.

15. The apparatus of claim 1, wherein the guide portion has a recess so that glue dispensed from the nozzle will not contact the guide portion.

16. The apparatus of claim 1, further comprising means for supplying glue to the glue head.

17. The apparatus of claim 16, wherein the means for supplying glue is a tube connected between the glue head and a remote source of glue.

18. The apparatus of claim 1, wherein the glue is a hot-melt type.

19. An adjustable apparatus for dispensing glue onto side flaps of cartons loaded with articles moving past the apparatus on a packaging machine, comprising:

(a) a glue dispensing head having at least one nozzle for dispensing glue onto the side flaps of the loaded cartons;

(b) a clamping block connected by a bracket to the glue dispensing head, the clamping block having a rectangular first aperture;

(c) a flap guide connected to the bracket, the flap guide having a guide portion adapted for pushing the side flaps of loaded cartons closed against articles in the cartons as the cartons move past the apparatus and as the nozzle dispenses glue onto the side flaps.

(d) a rack attached to the machine, the rack being received in the first aperture of the clamping block, the rack having teeth along the rack;

(e) a rotatable pinion shaft supported by the clamping block, the pinion shaft having a first a first end portion and a second end portion opposite the first end portion, the pinion shaft having at least a portion that is threaded; and (f) a pinion gear attached to the first end portion of the pinion shaft, the pinion gear having teeth which engage the teeth of the rack such that the clamping block is moved along the rack when the pinion gear is rotated to adjust the position of the glue dispensing head and the flap guide proximate to the side flaps in a desired position for loaded cartons of a particular size.

20. An adjustable gluing apparatus for dispensing hot-melt glue onto side flaps of cartons loaded with articles moving past the apparatus on a packaging machine, comprising:

(a) a base attached to the packaging machine;

(b) a rack attached to the base, the rack being an elongated bar having a first side and a second side, the rack having teeth disposed along the first side, and the second side being substantially flat and disposed opposite the first side;

(c) a clamping block, the clamping block having a rectangular first aperture which receives the rack, the first aperture having a first side and a second side adjacent the first side, the second side of the first aperture being adjacent the second side of the rack, the clamping block having a second aperture normal to the first aperture, the second aperture extending from the first side of the first aperture outward through the clamping block, the clamping block having a third aperture extending from the second side of the first aperture outward through the clamping block, the third aperture being threaded;

(d) a pinion shaft received by the second aperture in the clamping block, the pinion shaft having a first end portion disposed in the first aperture, and a second end portion disposed outside the clamping block, the second end portion having at least a portion that is threaded;

(e) a pinion gear attached to the first end portion of the pinion shaft, the pinion gear disposed substantially within the first aperture of the clamping block, the pinion gear having teeth which engage the teeth of the rack such that the clamping block is moved along the rack when the pinion gear is rotated;

(f) an adjustment knob attached to the second end portion of the pinion shaft such that rotation of the adjustment knob rotates the pinion shaft;

(g) a locking knob disposed on the pinion shaft between the adjustment knob and the clamping block and threadably engaged with the threaded portion of the pinion shaft, the locking knob being rotatable relative to the pinion shaft to selectively engage and disengage the clamping block;

(h) a threaded teeth-engagement adjusting shaft received by and threadably engaged with the third aperture in the clamping block, the teeth-engagement adjusting shaft having a first end which selectively engages and disengages the second side of the rack, and a second end portion opposite the first end;

(i) an adjusting knob attached to the second end portion of the teeth-engagement adjusting shaft such that rotation of the adjustment knob rotates the teeth-engagement adjusting shaft;

(j) a locking knob disposed on the teeth-engagement adjusting shaft between the adjusting knob and the clamping block and threadably engaged with the teeth-engagement adjusting shaft, the locking knob being rotatable relative to the teeth-engagement adjusting shaft to selectively engage and disengage the clamping block;

(k) a glue dispensing head connected to the clamping block, the glue dispensing head having at least one nozzle for dispensing glue onto the flaps of the cartons;

(l) a flap guide connected to the clamping block, the flap guide having a guide portion which extends adjacent to at least one nozzle, the guide portion having a recess so that glue dispensed from the nozzle will not contact the guide portion; and (m) a tube connected between the glue dispensing head and a remote source of glue.

* * * * *